United States Patent [19]

Napolitane

[11] 4,388,935

[45] Jun. 21, 1983

[54] HINGELESS COMPACT

[76] Inventor: Andrew N. Napolitane, 350 E. 52nd St., New York, N.Y. 10022

[21] Appl. No.: 259,023

[22] Filed: Apr. 30, 1981

[51] Int. Cl.[3] ..... A45D 33/00

[52] U.S. Cl. ..... 132/83 R

[58] Field of Search ..... 132/83, 79 R, 79 F, 132/79 G

[56] References Cited

U.S. PATENT DOCUMENTS

| | | | |
|---|---|---|---|
| 1,453,563 | 5/1923 | Albert | 132/83 R |
| 1,837,722 | 12/1931 | McAtree | 132/83 R |
| 1,875,541 | 9/1932 | Zell | 132/83 R |
| 2,031,933 | 2/1936 | Clegg | 132/83 R |
| 3,179,891 | 4/1965 | Sharma | 132/79 A |
| 3,431,918 | 3/1969 | Neumann et al. | 132/79 R |

*Primary Examiner*—G. E. McNeill

*Attorney, Agent, or Firm*—Hedman, Casella, Gibson, Costigan and Hoare

[57] ABSTRACT

A hingeless compact is disclosed for holding cosmetic articles. The compact includes a plate member and cover member having complimentary configurations such that in the closed condition of the compact a smooth surfaced enclosure is defined. The cover and plate members are provided with cooperating structures including opposed interlocking detents for maintaining the compact in a closed condition. Preferably, an additional stop rib is provided to prevent the inadvertent removal of the cover member from the plate member.

23 Claims, 11 Drawing Figures

HINGELESS COMPACT

BACKGROUND OF THE INVENTION

The subject invention relates to a compact for carrying cosmetics. More particularly, a hingeless compact is disclosed having a smooth surfaced enclosure and a unique locking means.

In the prior art, various containers have been used for holding and dispensing cosmetics. Typically, smaller, transportable containers, referred to as compacts, consist of a pair of plates hingedly connected at their rear edge and including a locking means in the front. To open the compact, the user would release the front locking means and rotate the cover plate upwardly, about the hinged connection to the bottom plate, to expose the cosmetics.

The above described conventional cosmetic compact has a variety of shortcomings. For example, hinges and locking mechanisms, which project beyond the smooth surfaced enclosure of the container, frequently catch on threads of clothing or purse linings causing them to tear. Further, the locking mechanism, usually consisting of adjacent, tightly interengaged pins, is frequently difficult to open if the user has long nails. In addition, the hinges themselves are prone to breakage, particularly where the hinges are plastic strips connecting the top and bottom cover plates, such that frequent bending often results in structural failure.

Accordingly, it is an object of the subject invention to provide a new and improved compact for carrying cosmetics having a smooth surfaced envelope enclosure.

It is another object of the subject invention to provide a new and improved compact for carrying cosmetics which is hingeless.

It is a further object of the subject invention to provide a compact for carrying cosmetics which includes a new and improved locking means for maintaining the cover and plate members in a closed condition.

It is still another object of the subject invention to provide a new and improved compact for carrying cosmetics wherein a locking means is provided to prevent the inadvertent separation between the cover and plate members.

It is still a further object of the subject invention to provide a new and improved hingeless compact which is aesthetically pleasing.

SUMMARY OF THE INVENTION

In accordance with these and many other objects, the subject invention provides for a hingeless compact for carrying cosmetic articles. The subject compact includes a generally rectangular plate member having front, rear and two opposed side edges. The upper surface of the plate member is configured with recesses adapted to hold cosmetic articles such as powders and brushes.

The plate member is provided with a continuous flange formed integrally therewith, circumscribing the front and side edges. The flange extends above and below the planes of the upper and lower surfaces of the plate member. Each opposed surface of the plate member includes a pair of opposed shelves which extend along the length of the side edges of the plate member. Each shelf is spaced from the outwardly extending free end of the adjacent flange and extends perpendicular thereto. The shelf cooperates with the flange to guide the slidable movement of the cover member relative to the plate member.

A generally U-shaped cover member is provided which is adapted to encase the opposed surfaces of the plate member. The cover member has a configuration complimentary to the plate member such that a smooth surfaced enclosure is defined when the compact is closed. More specifically, the perimeter of the flange defines the plan dimensions of the cover member such that an abutting contiguous relationship is achieved therebetween. When the cover member is moved relative to the plate member the inner surfaces of the cover member slidably move along the supporting shelves.

In the preferred embodiments of the subject invention, cooperating structures are formed integrally with the plate and the cover members to define a locking means for maintaining the cover member in a closed position. More specifically, each shelf of the plate member is provided with an outwardly extending detent disposed adjacent to but spaced from the front edge of the plate member. The cover member includes a cooperating detent associated with each detent of the plate member. The cooperating detent is formed integrally with the inner surface of the cover member and extends inwardly therefrom. The cooperating detent is disposed such that in a closed position of the compact, each cooperating detent is located between the opposed associated detent and the front edge of the plate member thereby aiding in maintaining the compact in the closed position. Preferably, the side walls of the detents are angled to provide a camming action during the movement of the cover member relative to the plate member.

Each shelf is further provided with a stop rib disposed adjacent the rear edge of the plate member. By this arrangement, when the compact is opened, each cooperating detent of the cover member engages with the associated stop rib to inhibit the inadvertent removal of the cover member from the plate member.

In one preferred embodiment of the subject invention, the inner surfaces of the cover member are provided with rails, formed adjacent the side edges thereof, which project inwardly towards each other. The rails are adapted to travel on the associated shelves of the plate member when the cover member is moved relative thereto. In addition, the rails function to rigidify the cover member. In this embodiment of the subject invention, the stop ribs and the detents of the plate member are spaced from the adjacent flange such that the rails of the cover member travel along the shelf in the space defined between the adjacent flange and the rib or detent.

In another embodiment of the subject invention, each shelf of the plate member is provided with a longitudinally extending channel adapted to slidably receive the opposed cooperating detents of the cover member. In the latter embodiment of the subject invention, the detents and the stop ribs of the plate member are located within the channels.

Further objects and advantages of the subject invention will become apparent from the following detailed description taken in conjunction with the drawings in which.

DESCRIPTION OF THE PREFERRED EMBODIMENTS

Figure 1:
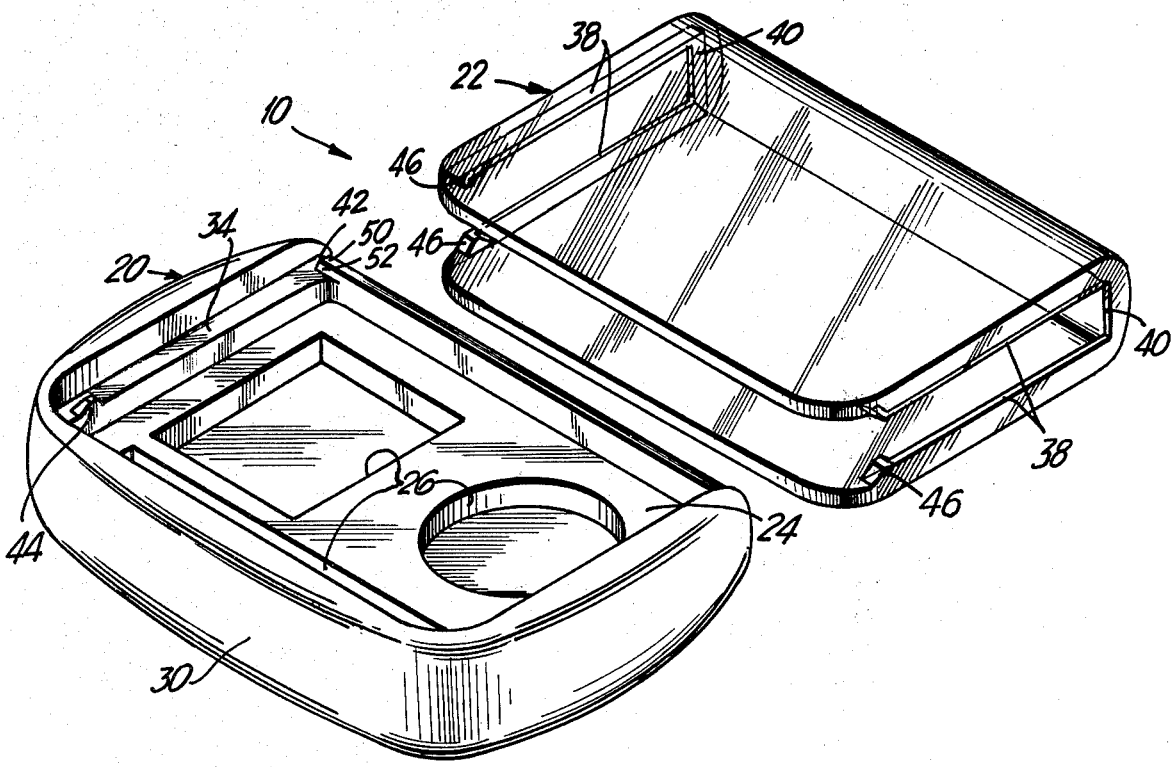
FIG. 1 is an exploded perspective view of a first embodiment of the new and improved hingeless compact of the subject invention illustrating the plate member and the cover member.
Figure 2:
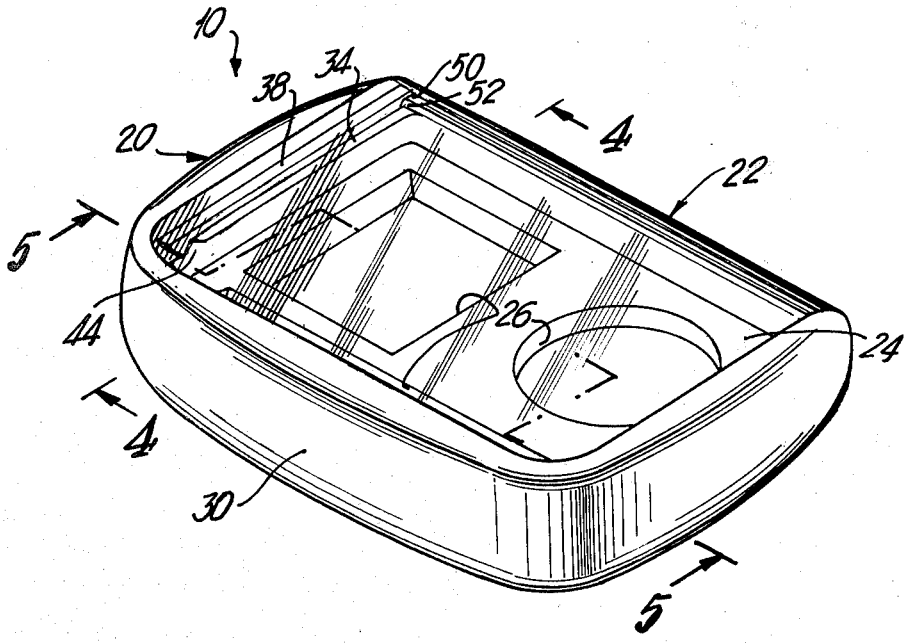
FIG. 2 is a perspective view of the first embodiment of the new and improved hingeless compact of the subject invention in the closed condition.
Figure 3:
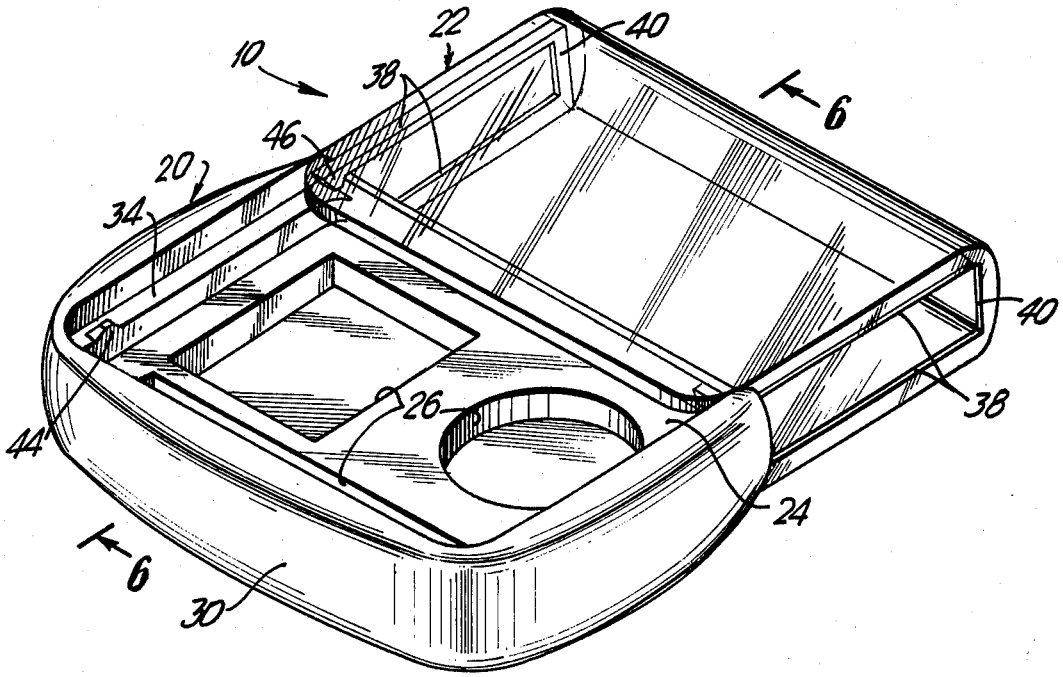
FIG. 3 is a perspective view of the first embodiment of the hingeless compact of the subject invention in the open condition.

Referring to FIGS. 1 through 3, there is illustrated a first embodiment of the hingeless compact 10 of the subject invention. The compact 10 comprises a plate member 20 and a cover member 22 having complimentary configurations such that in the closed condition, a smooth surfaced enclosure is defined.

Figure 4:
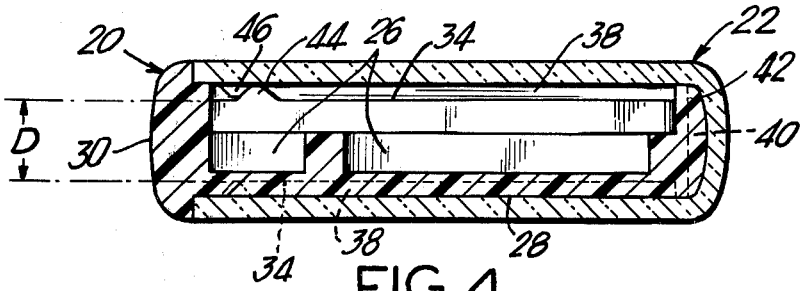
FIG. 4 is a cross-sectional view of the hingeless compact of the subject invention taken along the line 4—4 in FIG. 2.
Figure 5:
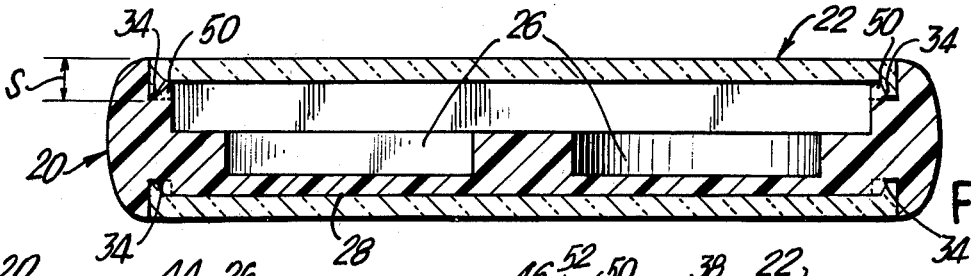
FIG. 5 is a cross-sectional view of the hingeless compact of the subject invention taken along line 5—5 in FIG. 2.
Figure 6:
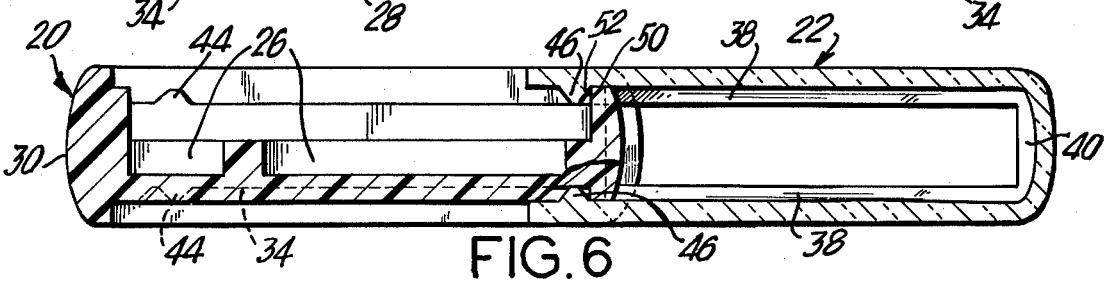
FIG. 6 is a cross-sectional view of the hingeless compact of the subject invention taken along line 6—6 in FIG. 3.
Figure 7:
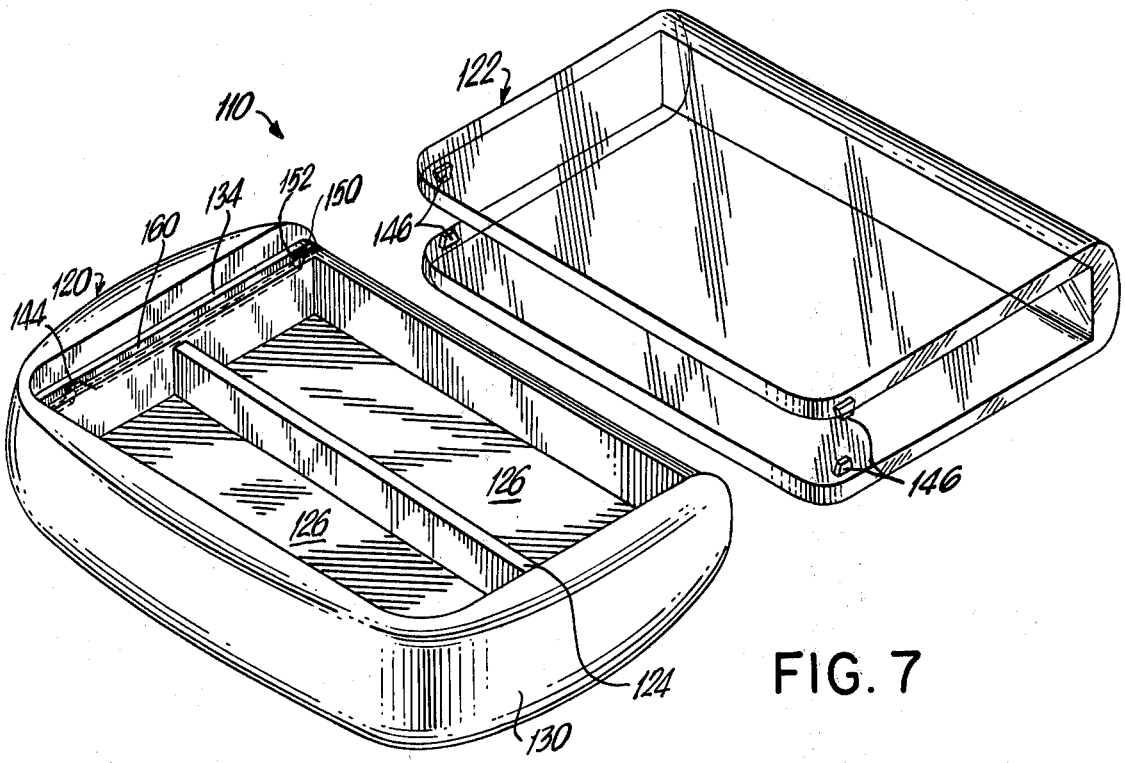
FIG. 7 is an exploded perspective view of a second embodiment of the new and improved hingeless compact of the subject invention, illustrating the plate member and the cover member.

The plate member 20 is generally rectangular in configuration and includes an upper surface 24 which is configured to receive cosmetics. As illustrated in FIGS. 4–6, upper surface 24 may be provided with a plurality of recesses 26 which can be utilized to hold for example, powdered cosmetics, a mirror or a brush (not shown). Preferably, the plate member 20 is integrally formed of plastic material in a molding operation, with the lower surface 28 thereof being essentially planar in configuration. Accordingly, when different types of cosmetic articles are to be contained, only the configuration of the upper surface 22 must be altered to accommodate the varied shapes. Thus, when produced in a molding operation, only the upper core half of the mold need be modified to alter the configuration of recesses 26.

A continuous flange 30 is provided which extends around the front and side edges of plate member 20. Flange 30 projects both above and below the planes of the opposed surfaces 24, 28 of the plate member. Preferably, the edges of the flange 30 are rounded to provide a desirable aesthetic appearance.

In accordance with the subject invention, both the upper and lower surfaces of the plate member include a pair of opposed shelves 34. Shelves 34 extend along the length of the side edges of the plate member 20 from the front to the rear thereof. As illustrated in FIG. 5, each shelf is spaced away from the outwardly extending free end of the flange and distance S and is disposed perpendicular to the latter. The flange 30 and shelves 34 cooperate to guide the cover 22 into and out of the closed position.

Cover member 22 is generally U-shaped in configuration and is preferably formed of a transparent material enabling the articles within the compact to be viewed while in the closed condition. In the first embodiment of the subject invention, the inner surfaces of the cover member 22 are provided with a pair of upper and lower rails 38, extending along the side edges thereof. The rails project inwardly, towards each other an amount such that the total thickness of each arm of the U-shaped cover measured at the rails, is substantially equal to the distance S corresponding to the spacing between the free end of the flange 30 and each shelf 34, as illustrated in FIG. 5. This complimentary relationship aids in providing a smooth enclosure, as described immediately hereinbelow. In addition to cooperating with the shelves of the plate member for guiding the cover member, rails 38 also function to add rigidity to the cover. A vertical rail segment 40 may be provided for engagement with slots 42 of plate member 20 which also rigidifies the compact in the closed condition, as illustrated in FIG. 4.

In use, cover member 22 is adapted to encase the plate member 20 and define a smooth surfaced enclosure. More specifically, in the closed position, as illustrated in FIGS. 2, 4, and 5, the upper and lower arms of the U-shaped cover member 22 are wrapped around the upper and lower surfaces 24, 28 of the plate member, with the rails 38 being slidably received along the associated shelves 34. The dimensions of the complimentary plate and cover members are regulated to define the smooth surfaced enclosure. More specifically, the distance between the side edges of the cover member 22 substantially conforms to the spacing between the flange portions 30 adjacent the side walls of the plate member. Similarly, the width of the cover member, measured from the front to rear edges, substantially conforms to the width of the plate member. In addition, the total height of the cover member substantially conforms to the height of the flange 30. Also, and as discussed above, the thickness of each arm of the U-shaped cover member, measured along the rib, conforms to the spacing S between the free end of the flange and the associated shelf. Accordingly, due to the above described complimentary configurations, when the compact is in the closed condition, a smooth surfaced enclosure is defined having no projections which could inadvertently snag threads of clothing.

As mentioned above, the rails 38 of the cover member are slidably received along shelves 34 of the plate member. When the cover member is moved relative to plate member, the rails 38 ride along the associated shelves and are guided by the adjacent flange enabling the cover member to be smoothly channeled into either the open or closed position. Preferably, in the manufacture of U-shaped cover member 22, the separation between the free ends of upper and lower rails 38 is made slightly less than the distance D between the opposed surfaces of the upper and lower shelves 34, as illustrated in FIG. 4. By this arrangement, when the cover member is installed on the plate member, the resilient qualities of the plastic cover member 22 causes a frictional engagement to be established between the associated rails and shelves.

Under normal circumstances, the above described frictional engagement between the rails and the shelves is sufficient to maintain the compact in the closed condition when desired, and to prevent the cover member from inadvertently becoming separated from the plate member when opened. However, as can be appreciated, the subject compact will often be carried loosely in a purse and therefore subject to frequent vibrations tending to cause the cover member to move towards an open position. Accordingly, the plate and cover members of the subject invention are provided with cooperating structures which define a locking means for maintaining the compact in the closed condition. More specifically, each shelf member is provided with a detent 44 which extends outwardly therefrom. Each detent 44 is disposed adjacent to but spaced from the front edge of plate member 20. In addition, each detent is spaced from the adjacent side edge of the plate member to define a path for the associated rail.

The cover member 22 is also provided with an inwardly projecting cooperating detent 46, associated with each of the detents 44 of the plate member. Each cooperating detent 46 is formed integrally with the associated rail and has a width, which is greater than the width of the rail, and substantially conforms to the width of the shelf. Each detent 46 is disposed such that in the closed condition of the compact, the cooperating detent 46 is interposed between the opposed detent 44 and the front edge of the plate member. As illustrated in FIG. 4, an interengagement is achieved between the cooperating detents 44 and 46 such that a significantly increased amount of force must be provided to initially move the cover member out of the closed position. Each of the detents 44, 46 is provided with angled side walls to create a camming action therebetween when the detents are moved into and out of engagement. The angle of the side walls of the detent can be regulated to control the amount of camming action and hence the force required to open or close the compact.

In use, when the compact 10 is to be opened, a withdrawal force is applied to the cover member 22 tending to move it into the open position. The cam action between the cooperating detents causes the upper and lower arms of the U-shaped cover member to widen or expand as detents 46 rise up and over detents 44. Once the detent 46 is moved past the stationary detent 44, the cover member 12 may be readily slid to the open position. Similarly, when closing the compact 10, the cover member may be easily moved towards the front of the plate member until the detents are in abutting relationship. Then the cam action between the detents enables the upper and lower arms of the cover member to widen as detents 46 ride up and over detents 44 such that the locked position is achieved as illustrated in FIGS. 2 and 4.

As discussed above, the resilient characteristics of the cover member creates a frictional engagement between the associated ribs and shelves thereby preventing the cover from inadvertently moving relative to the plate member. As can be appreciated, however, as the cover member is moved towards the open position as illustrated in FIG. 3, the amount of surface area of the shelves and rails which are in abutting contact is substantially reduced thereby correspondingly reducing any frictional engagement therebetween. Accordingly, the subject invention may further be provided with a stop means to inhibit the inadvertent removal of the cover member 22 from the plate member 20. More specifically, a stop rib 50 is provided and is formed integrally with each shelf. Rib 50 is disposed adjacent the rear end of the shelf and projects outwardly therefrom. Similar to detent 44, rib 50 is spaced from the side edge of the plate member to define a path for the associated rail 38. As illustrated in FIGS. 3 and 6, rib 50 is operative to prevent the inadvertent removal of the cover member 22 from the plate member 20. More specifically, when cover member 22 is drawn towards the open position, detents 46 come into abutting contact with the associated ribs 50 thereby preventing any further outward movement of the cover member. Preferably, the surface 52, in contact with the detents 46 is planar and disposed perpendicular to the shelf. In contrast to the angled configuration of the side walls of the detents, the straight surface 52 prevents any camming action from occurring. Thus, a relatively large amount of force would be necessary in order to remove the cover member 22 from the plate member 20. Accordingly, locking means are provided in the subject invention to prevent the cover from being inadvertently removed from the plate member as well as for maintaining the compact in a closed condition.

Referring now to FIGS. 7 through 11, there is illustrated a second embodiment of the hingeless compact of the subject invention, wherein like parts have corresponding numbers indexed by 100. The compact 110 consists of a plate member 120 and a cover member 122. Plate member 120 is generally rectangular in configuration having upper and lower surfaces 124 and 128 respectively. As in the first embodiment of the subject invention, the lower surface 128 is planar while the upper surface 124 is provided with a plurality of recesses 126 configured for holding cosmetics. A continuous flange 130 is provided which extends along the front and side edges of the plate member 120. Preferably, the edges of the flange 130 are rounded to provide a desirable aesthetic appearance.

Similar to the first embodiment of the subject invention, the upper and lower surfaces of the plate member 120 include a pair of opposed shelves 134, which extend along the length of the side edges of the plate member. In accordance with the second embodiment of the subject invention, each shelf 134 is provided with a longitudinally extending channel 160. Channels 160 are adapted to receive the opposed guiding detents 146 formed on the cover member 122, as discussed more fully immediately hereinbelow.

Similar to the first embodiment of the subject invention, shelves 134 may be provided with upwardly projecting detents 144 and stop ribs 150. In this embodiment of the subject invention, each detent 144 is disposed within the associated channel 160 at a point adjacent to, but spaced from the front of the plate member 120. Each stop rib 150 is disposed within the associated channel 160 adjacent the rear of the plate member 130.

In the second embodiment of the subject invention, the U-shaped cover member 122 is provided with a plurality of guiding detents 146 which project toward each other from the inner surfaces thereof. The guiding detents 146 are disposed to be in alignment with channels 160 such that when the cover member 122 is moved relative to the plate member 120, the guiding detents 146 travel along channels 160. In contrast to the first embodiment of the subject invention, cover member 122 does not include longitudinally extending rails, such that side edges of the inner surfaces of the cover member ride along the associated shelf 134 while each guiding detent 146 travels within a channel 160. Accordingly, in order to provide the desired smooth surfaced enclosure, each shelf 134 is spaced away from the outwardly extending free edge of the flange 130 a distance $S_1$, substantially corresponding to the thickness of each arm of the U-shaped cover member. By this arrangement, the complimentary configuration is maintained insuring a smooth surfaced enclosure.

Similar to the first embodiment of the subject invention, guiding detents 146 are located such that in the closed condition of the compact 110, each detent 146 is disposed between the associated opposed detent 144 and the front edge of the plate member. Preferably, the side edges of all the detents are angled to provide the camming action, as discussed above.

In use, when the compact 110 is to be opened, a withdrawal force is applied to the cover member 122 tending to move it into the open position. The cam action between the cooperating detents causes the upper and lower arms of the U-shaped cover member 122 to widen or expand as detents 146 rise up and over detents 144. Once the detents 146 are moved past the stationary detents 144, the spring-like resiliency of the cover member drives the detents 146 back within the channels 160, facilitating the guidance of the cover member relative to the plate member. Continued movement of the cover member 122 to its open position causes guiding detents 146 to come into abutting contact with the straight vertical surface 152 of stop ribs 150 thereby substantially inhibiting the inadvertent separation between the members.

Figure 8:
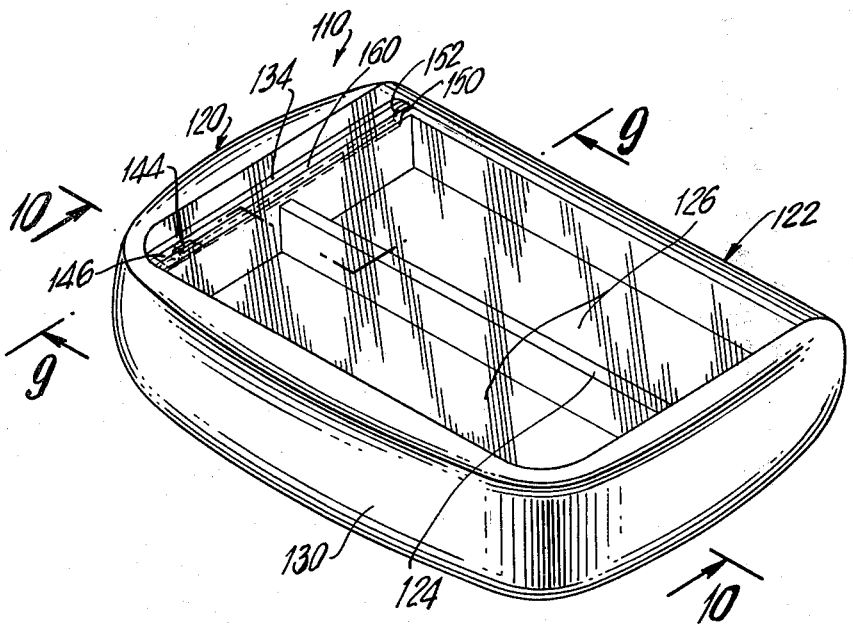
FIG. 8 is a perspective view of the second embodiment of the hingeless compact of the subject invention in the closed condition.
Figure 9:
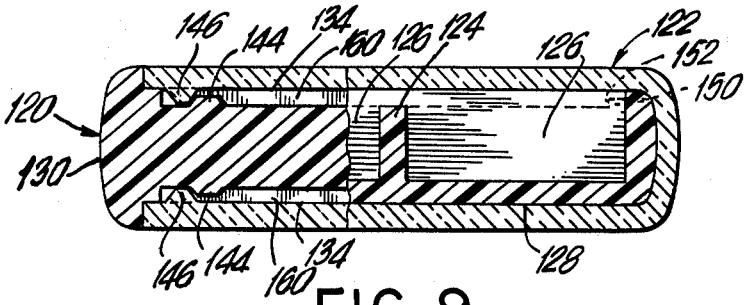
FIG. 9 is a cross-sectional view of the hingeless compact of the subject invention taken along the line 9—9 in FIG. 8.
Figure 10:
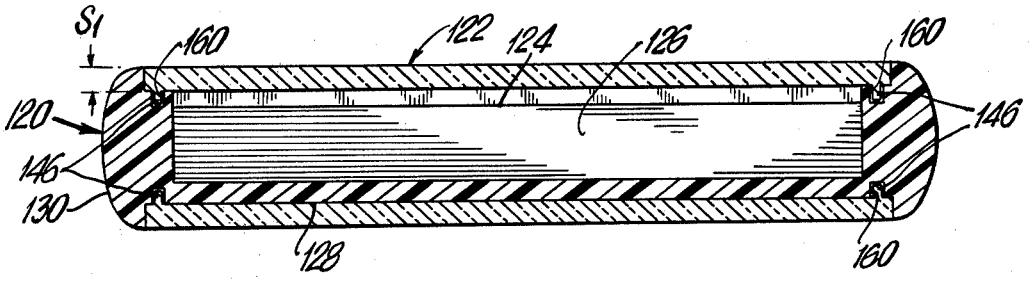
FIG. 10 is a cross-sectional view of the hingeless compact of the subject invention taken along line 10—10 in FIG. 8.
Figure 11:
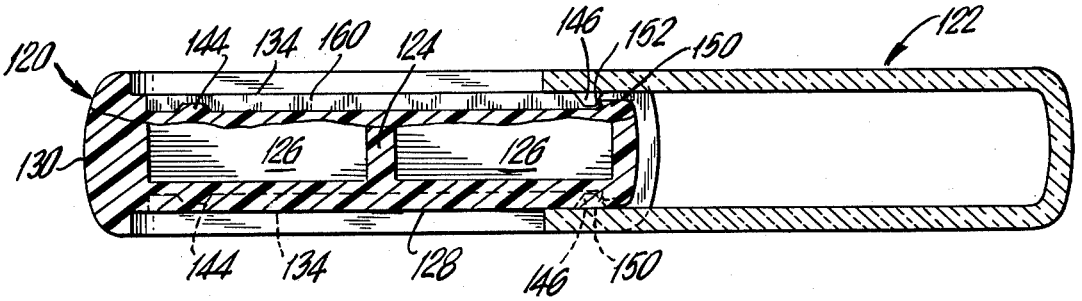
FIG. 11 is a cross-sectional view, similar to FIG. 6, of the second embodiment of the hingeless compact of the subject invention.

The compact may be readily closed by sliding the cover member 122 towards the front of the plate member until the opposed detents are in abutting relationship. Added closing pressure initiates the cam action between the detents enabling guiding detents 146 to ride up and over stationary detents 144 to achieve the locked configuration as illustrated in FIGS. 8 and 9.

In summary, there is provided a new and improved compact for holding cosmetic articles. More specifically, the compact 10 includes a generally rectangular plate member 20 with the upper surface 22 thereof being configured to hold cosmetic articles. The plate member 20 includes a continuous flange 30 formed integrally therewith and circumscribing the front and side edges thereof. The flange 30 extends above and below the planes of the upper and lower surfaces of the plate member. The plate member further includes shelves 34 which extend along the length of the side edges thereof. Each shelf is spaced from the free end of the adjacent flange and is disposed perpendicular thereto. A U-shaped cover member 22 is provided adapted to encase the plate member and having a configuration complimentary thereto. In the closed condition of the compact, a smooth surfaced enclosure is defined. When the compact is opened, the cover member is moved in a direction towards the rear of the plate member, and is guided by the flange, with the side edges of the cover member slidably moving along the associated shelf. In the preferred embodiments of the subject invention, cooperating detents are provided on the cover member and shelves of the plate member respectively, for maintaining the compact in the closed condition. In addition, a stop rib can be provided on the rear of each shelf to prevent the inadvertent removal of the cover member from the plate member. In one embodiment of the subject invention the side edges of the inner surfaces of the cover member are provided with projecting rails 38 adapted to slidably move along the associated shelves. In an alternate embodiment, each shelf is provided with a longitudinally extending channel 160 adapted to receive and guide the opposed detent formed on the cover member.

While the subject invention has been described with reference to a preferred embodiment, it will be apparent that other changes and modifications can be made therein without departing from the scope and spirit of the subject invention as defined by the appended claims.

What is claimed is:

1. A hingeless compact for cosmetic articles comprising:

a generally rectangular plate member having front, rear and two opposed side edges with the upper surface of said plate member being configured to hold cosmetic articles, said plate member including a continuous flange formed integrally therewith and circumscribing said front and side edges, said flange extending above and below the plane of the upper and lower surfaces of said plate member respectively, said upper and lower surfaces each including a pair of opposed shelves extending along the length of said side edges with each said shelf being spaced from the free end of the adjacent flange and extending perpendicular thereto; and a generally U-shaped resilient cover member adapted to slidably encase said plate member and having a configuration complimentary thereto, with the perimeter of said flange defining the dimensions of said cover member such that in the closed condition of said compact a smooth surfaced enclosure is defined, said U-shaped resilient cover member cooperating with said plate member to frictionally maintain said compact in a closed condition and whereby when said compact is opened said cover member is slidably moved in a direction towards the rear of said plate member guided by said flange, with the side edges of said cover member slidably moving along said shelves.

2. A hingeless compact as recited in claim 1 wherein said cover member includes upper and lower rails disposed adjacent the side edges thereof, said rails being formed on the inner surfaces of said cover member, projecting toward each other, said rails being adapted to slidably move along the associated shelves when said cover member is moved relative to said plate member.

3. A hingeless compact as recited in claim 2 further including a locking means for maintaining said compact in a closed condition.

4. A hingeless compact as recited in claim 3 wherein said locking means is defined by cooperating structures formed integrally with said plate and cover members, with each shelf of said plate member including an outwardly extending detent disposed adjacent to, but spaced from said front edge of said plate member and with said cover member including a cooperating detent associated with each detent of said plate member, each said cooperating detent formed integrally with the inner surface of said cover member and extending inwardly therefrom, each said cooperating detent being disposed such that in the closed condition of said compact, said cooperating detent is located between the opposed detent and said front edge of said plate member thereby aiding in maintaining said compact in the closed condition.

5. A hingeless compact as recited in claim 4 wherein the side edges of each said detent are angled to provide a cammed sliding action between opposed detents during the movement of the cover member relative to the plate member.

6. A hingeless compact as recited in claim 4 wherein each said detent formed on said plate member is spaced from the adjacent side edge thereof such that said rails are slidably received in the space defined between said detent and the adjacent flange of the plate member.

7. A hingeless compact as recited in claim 4 further including a stop means for inhibiting the inadvertent removal of said cover member from said plate member.

8. A hingeless compact as recited in claim 7 wherein each said shelf further includes a stop rib defining said stop means, each said stop rib formed integrally with said shelf and extending outwardly therefrom adjacent the rear edge of said plate member whereby when said compact is opened with said cover member being moved towards the rear of said plate member, each said cooperating detent of said cover member engages with the associated stop rib to inhibit the inadvertent removal of said cover member from said plate member.

9. A hingeless compact as recited in claim 8, wherein each said stop rib is spaced from the adjacent side edge of said plate member, such that the associated rail of said cover member is slidably received in the space defined between said stop rib and the adjacent flange of said plate member.

10. A hingeless compact as recited in claim 8 wherein the surface of each said stop rib which engages the associated detent of said cover member is planar in configuration and disposed perpendicular to the associated shelf.

11. A hingeless compact as recited in claim 1 wherein each said shelf further includes a longitudinally extending channel and wherein said cover member further includes a guiding detent associated with each channel in said cover member, said guiding detents being formed integrally with the inner surface of said cover member and extending inwardly therefrom, each said guiding detent being receivable in the associated channel in said plate member and adapted to be slidably movable therein when said cover member is moved relative to said plate member.

12. A hingeless compact as recited in claim 11 further including a locking means for maintaining said compact in a closed condition.

13. A hingeless compact as recited in claim 12 wherein each shelf of said plate member further includes an outwardly extending locking detent disposed within the associated channel thereof, adjacent to but spaced from said front edge of said plate member, said locking and guiding detents cooperating to define said locking means, with each said guiding detent being disposed such that in the closed condition of said compact, said guiding detent is located between the opposed locking detent and said front edge of said plate member thereby aiding in maintaining the compact in a closed condition.

14. A hingeless compact as recited in claim 13 wherein the side edges of each said detent are angled to provide a cam sliding action between opposed detents during the movement of the cover member relative to the plate member.

15. A hingeless compact as recited in claim 13 further including a stop means for inhibiting the inadvertent removal of said cover member from said plate member.

16. A hingeless compact as recited in claim 15 wherein each said shelf further includes a stop rib defining said stop means, each said stop rib being formed within said channel and extending outwardly therefrom adjacent the rear edge of said plate member, whereby when said compact is opened, with said cover member being moved towards the rear of said plate member, each said guiding detent of said cover member engages the associated stop rib to inhibit the inadvertent removal of said cover member from said plate member.

17. A hingeless compact as recited in claim 16 wherein the surface of each said stop rib which engages the associated guiding detent of said cover member is planar in configuration and disposed perpendicular to the associated shelf.

18. A hingeless compact for cosmetic articles including improved locking means comprising:

a generally rectangular plate member having front, rear and two opposed side edges with the upper surface of said plate member being configured to hold cosmetic articles, said plate member including a continuous flange formed integrally therewith and circumscribing said front and side edges, said flange extending above and below the plane of the upper and lower surfaces of said plate member respectively, said upper and lower surfaces each including a pair of opposed shelves, said shelves extending along the length of said edges, with each said shelf being spaced from the free end of the adjacent flange and extending perpendicular thereto, with each said shelf including an outwardly extending detent disposed adjacent to but spaced from said front edge of said plate member; and a generally U-shaped cover member adapted to encase said plate member and having a configuration complimentary thereto, with the perimeter of said flange defining the dimensions of said cover member such that in the closed condition of said compact a smooth surfaced enclosure is defined, with said cover member further including a cooperating detent associated with each detent of said plate member, each said cooperating detent formed integrally with the inner surface of said cover member and extending inwardly therefrom, each said cooperating detent being disposed such that in the closed condition of the compact, said cooperating detent is located between said opposed detent and the front edge of the plate member thereby aiding in maintaining said compact in the closed condition, and whereby when said compact is opened, said cover member is moved in a direction towards the rear of said plate member with the side edges of said cover member slidably moving along said shelves.

19. A hingeless compact as recited in claim 18 wherein the side edges of each said detent are angled to provide a cam sliding action between the opposed detents during the movement of the cover member relative to the plate member.

20. A hingeless compact as recited in claim 18 wherein each said shelf further includes a stop rib, each said stop rib being formed integrally with said shelf and extending outwardly therefrom adjacent the rear edge of said plate member whereby when said compact is opened, with said cover member being moved towards the rear of said plate member, each said cooperating detent of said cover member engages with the associated stop rib to inhibit the inadvertent removal of said cover member from said plate member.

21. A hingeless compact as recited in claim 18 wherein said cover member further includes upper and lower rails disposed adjacent the side edges thereof, said ribs being formed on the inner surface of said cover member projecting towards each other, said rails being adapted to slidably move along the associated shelves when said cover member is moved relative to said plate member.

22. A hingeless compact as recited in claim 21 wherein each said detent formed on said plate member is spaced from the adjacent side edge thereof such that said rails are slidably received in the space defined between said detent and the adjacent flange of the plate member.

23. A hingeless compact as recited in claim 18 wherein each said shelf further includes a longitudinally extending channel with said cooperating detent of said cover member being receivable therein such that when said cover member is moved relative to said plate member, said cooperating detent travels along the associated channel.

* * * * *

Disclaimer 4,388,935.—*Andrew N. Napolitane, New York, N.Y. HINGELESS COMPACT. Patent dated June 21, 1983. Disclaimer filed Nov. 23, 1988, by the inventor.*

The term of this patent subsequent to Apr. 12, 1997, has been disclaimed.

[*Official Gazette April 18, 1989.*]